US005385482A

United States Patent [19]

Rottner

[11] Patent Number: 5,385,482

[45] Date of Patent: Jan. 31, 1995

[54] WIRING CONNECTOR DEVICE

[75] Inventor: Michael L. Rottner, Alpharetta, Ga.

[73] Assignee: Georgian Art Lighting Designs, Inc., Lawrenceville, Ga.

[21] Appl. No.: 115,221

[22] Filed: Sep. 1, 1993

[51] Int. Cl.[6] ..... H01R 4/24

[52] U.S. Cl. ..... 439/409; 439/419

[58] Field of Search ..... 439/395–407, 439/409, 410, 411, 413, 417–419, 425, 721, 723, 724, 725, 790, 794

[56] References Cited

U.S. PATENT DOCUMENTS

| | | | |
|---|---|---|---|
| 349,516 | 9/1886 | Perkins . | |
| 1,045,273 | 11/1912 | Fisher . | |
| 1,309,406 | 7/1919 | Gilchrist . | |
| 3,328,742 | 6/1967 | Hanson . | |
| 3,651,443 | 3/1972 | Quilez . | |
| 3,735,329 | 5/1973 | Funabashi et al. . | |
| 3,897,993 | 8/1925 | Fleischhacker et al. | 439/723 |
| 4,079,244 | 3/1978 | Bortoluzzi . | |
| 4,214,805 | 7/1980 | Faulconer | 439/417 |
| 4,754,104 | 6/1988 | Maltais et al. | 439/417 |
| 4,767,354 | 8/1988 | Saligny | 439/724 |
| 4,781,616 | 11/1988 | Yu . | |

FOREIGN PATENT DOCUMENTS

| | | | |
|---|---|---|---|
| 0691802 | 5/1953 | United Kingdom | 439/418 |

*Primary Examiner*—David L. Pirlot
*Attorney, Agent, or Firm*—Jones & Askew

[57] ABSTRACT

A wiring connector device is disclosed for use in chandeliers and other electrical devices for eliminating the time, difficulty and expense involved in assembling chandeliers and similar lighting devices. The device includes a substrate, conductors, and several pairs of electrically conductive tines that are connected to the conductors. One tine in each pair is connected to a grounded conductor while the other tine is connected to an ungrounded conductor. A grooved clamp, corresponding to each pair of tines, channels a two conductor feeder wire from each chandelier arm into correct position over the tines and, when moved into a closed position, facilitates an electrical connection between the tines and the conductors of the two conductor feeder wire.

19 Claims, 5 Drawing Sheets

WIRING CONNECTOR DEVICE

TECHNICAL FIELD

The present invention relates to the field of electrical connectors, and in particular to an improved chandelier wiring connector that distributes electricity to multiple electrical sockets without requiring wire nuts, electrical tape and the like.

BACKGROUND OF THE INVENTION

Chandeliers are decorative and functional light sources that are used to illuminate rooms in a fashionable manner. Their size, price range and aesthetic features range from the small, inexpensive and purely functional to the large, very expensive and extremely elegant. The lighting configurations of these chandeliers vary with their styles. Some chandeliers may have a simple 4, 6 or 8 bulb configuration, while others may have multiple tiers of many lights each. For example, a bottom tier may contain ten lights, while a second tier may only contain five lights.

Regardless of their particular characteristics, all chandeliers possess two main elements—a set of arms that generally contains light sockets, and two conductor wires that supply power to the light sockets from a main power wire. The two conductor wires from all of the individual sockets run into a central connection housing in the chandelier known as the wire body. The wire body is the enclosed volume on the central axis of a chandelier in which all connections between the main power wire and the feeders to individual sockets are made. The presence of these wires in the wire body forces someone to engage in the tedious process of joining the feeder wires in the chandelier and insulating the connections. Each individual wire is joined with like wires from other sockets to a power feed line in the wire body. The limited space and numerous wires located within the wire body make the process of assembling and wiring a chandelier more difficult. Connecting this multitude of wires by conventional methods is one of the more time consuming tasks in the process of assembling a chandelier. A multi-tiered chandelier that contains numerous lamps creates an even greater space problem within the wire body than does a simple design with few lamps.

It is a drawback of the prior art that the individual feeder wires that supply electricity to the individual light sockets of the chandelier must be joined either through splicing, wire nuts, soldering and taping, or the like. These connecting methods and devices facilitate a permanent way of transferring electricity from a main power line to the light socket feeders. However, when trouble develops, such as a short circuit or a loose wiring connection, troubleshooting is difficult because one must deal with the large number of feeder wires connected in the limited space of the main housing in order to reach the individual wire connections. Sometimes merely disturbing the "rats nest" within the wire body will make the symptoms of a problem disappear, only to reappear later.

As an alternative to the aforementioned techniques, prior art wiring connectors, such as the connector disclosed by Fisher, U.S. Pat. No. 1,045,273, also have utilized a central conductor structure in which a main power wire distributes electricity from a central location to individual feeder wires of the chandelier arms through a central conductor configuration where a central non-grounded conductor is located either above or below a central grounded conductor. The two central conductors are separated by an insulating material.

Other wiring connectors, such as the connector disclosed by Perkins, U.S. Pat. No. 349,516, also incorporate a concentric conductor ring configuration that distributes electricity to feeder wires radially extending to the chandelier arms. Because feeder wires are not spliced to the main power line, these devices eliminate some of the problems and inconveniences resulting from the normal tangle of wires in the chandelier's wire body. These central electrical distribution devices also facilitate easier chandelier assembly.

However, these prior art central electrical distribution devices also suffer from certain drawbacks. Many of these devices require that the feeder wires be stripped for electrical contact with the central contacts before the feeder wires are set in place in either the chandelier wire body or the chandelier arms. Prior art devices are also very "chandelier specific", that is, the devices are specifically manufactured for accommodating one particular chandelier design and size. This inflexibility in application forces chandelier manufacturers and electricians using such devices to keep a large supply of these devices in stock to correctly equip the myriad of chandelier arm configurations and sizes. This inconvenience would result in increased cost to those who must stock and use these items. This result is such a limiting factor that such a possible expense-saving device is bypassed for more traditional chandelier wiring techniques by most assemblers of chandeliers.

The inventor of the present invention has discovered, through the nature of his work and profession, that the process of wiring a chandelier by the use of solder, wire nuts or other devices, for connecting the plurality of wires from the chandelier light sockets together and in turn joining them to a power feed line in a central wire body, is undesirable. The inventor believes that it would be more cost-efficient and less labor-intensive to connect each of the feeder wires from the chandelier arms with a device not heretofore known that would eliminate the need for solder, wire nuts or similar connection devices in making the electrical connections. Thus, the fundamental purpose of the present invention is to reduce the time required to assemble a chandelier. A secondary benefit is the neat and uncluttered wire body that results from its use. The inventor also believes that, because of its design, the present invention can be used in a wide variety of chandeliers and other electrical devices capable of using a multiple wiring connector. Because of its "universal" size, the present invention is not limited to particular chandelier designs and sizes and requires no special fittings or adapters.

SUMMARY OF THE INVENTION

The present invention overcomes the above-noted problems associated with the prior art. Stated generally, the present invention provides a multiple contact connector for use with a typical chandelier that minimizes the time and difficulty in wiring a chandelier or similar lighting device. The present invention also provides a multi-contact connector that is of universal size so that it may be used in chandeliers of various sizes and shapes.

Stated more specifically, the present invention comprises an electrical connection device that is mounted on a substrate supported at a support axis of the chandelier. The device includes a plurality of pairs of electrically conductive tines disposed radially on the substrate and about the support axis of the substrate. Each pair of electrically conductive tines comprises a grounded tine and an ungrounded tine. Both the grounded tine and the ungrounded tine are used to pierce the two conductor wire that is channeled from the light socket in the chandelier arm to the location of each pair of tines. The grounded tine pierces completely through one conductor of the two conductor wire and makes contact with a conductor mounted on the substrate that connects all of the grounded tines together. Likewise, the ungrounded tine pierces completely through the second conductor of the two conductor wire and makes contact with a conductor mounted on the substrate that connects all of the ungrounded tines together.

Each pair of tines is disposed under a clamp. This clamp is movable between an open position and a closed position. When the clamp is in the open position, the two conductor wire can be laid across the pair of tines. When the clamp is in a closed position, the clamp pushes the two conductor wire onto the pair of tines so that the tines pierce the two conductor wire and make the resulting connection with the grounded and the ungrounded conductors.

The use of the present invention allows a main power line to supply electricity to conductor segments of a two conductor wire through the substrate-mounted conductors conducting means without the need for the tangle of wires often found in a conventional chandelier's wire body. Furthermore, structural grooves that house the conductors and tines facilitate the ease of placement of the two conductor wire and allow the clamps to easily connect the wires to the tines and the substrate-mounted conductors.

Thus, it is an object of the present invention to provide a wiring connector device for use with a chandelier that allows one to eliminate the number of wires used and housed in a chandelier wire body.

It is a further object of the present invention to provide a wiring connector device that eliminates the time and expense involved in assembling and wiring a chandelier or other similar electrical device.

It is a further object of the present invention to provide a wiring connector device that supplies electricity to multiple feeder wires without the need to strip insulation from the feeder wires.

It is a further object of the present invention to provide a simple, inexpensive apparatus that is compatible with most chandeliers and that electricians and others in the lighting business will be willing to use.

It is still a further object of the present invention to provide a wiring connector device that channels individual feeder wires into correct positioning for proper connection with a main feeder wire.

That the present invention meets these and other objects will be appreciated from the detailed description of the preferred embodiment below.

BRIEF DESCRIPTION OF THE DRAWINGS

FIGS. 1*a* and 1*b* show front and rear views through the slot in the clamp of the preferred embodiment of the present invention.

DETAILED DESCRIPTION

Turning next to the drawings in which like numerals reference like parts, the preferred embodiment of the present invention will now be described.

Figure 1:
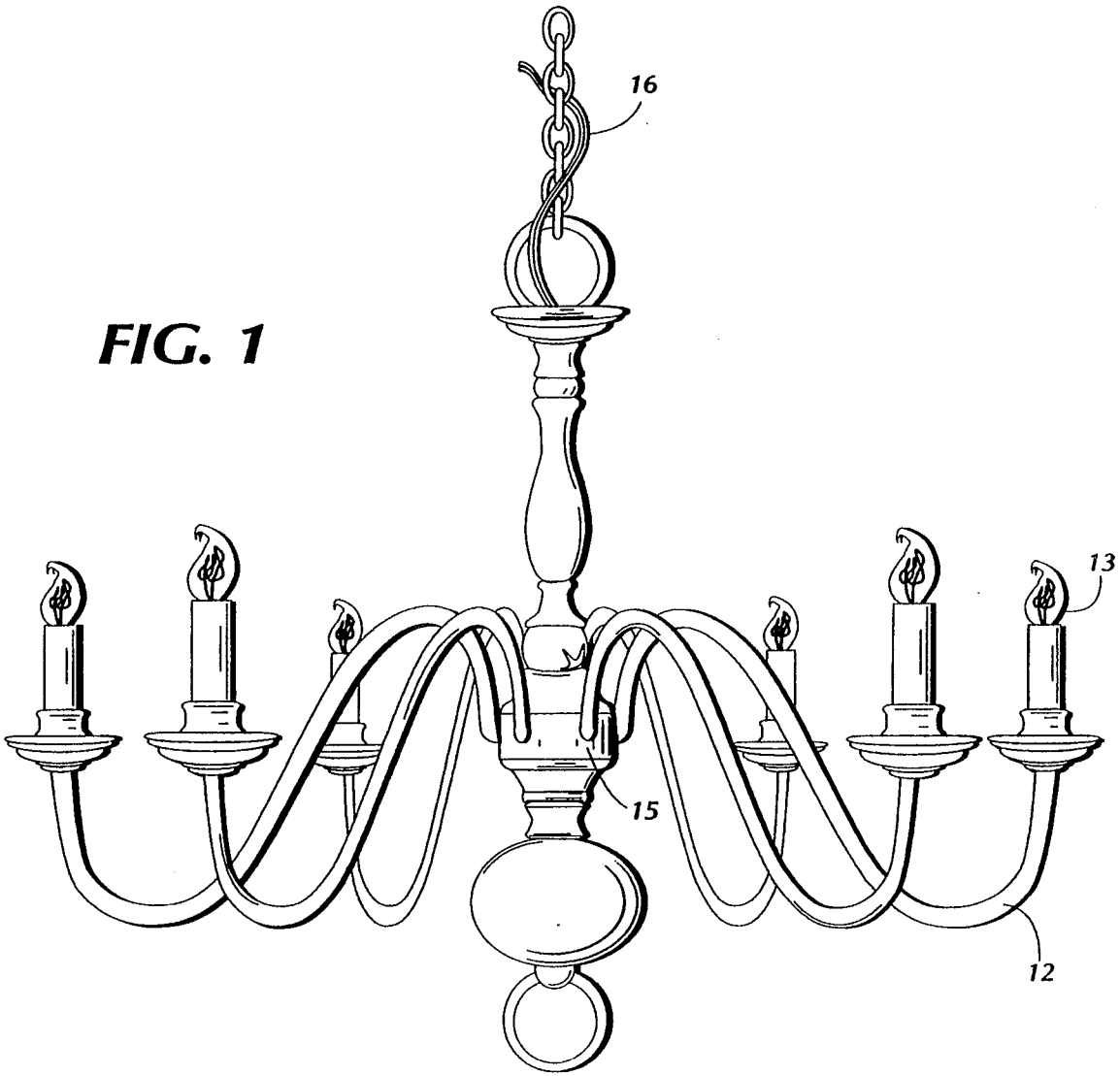
FIG. 1 is a side elevational view of a typical chandelier in which the present invention is utilized.

FIG. 1 shows a typical chandelier in which the present invention is used. Main components of a chandelier include a representative arm 12, a representative socket 13, a main wire body 15 and a main power line 16.

Figure 2:
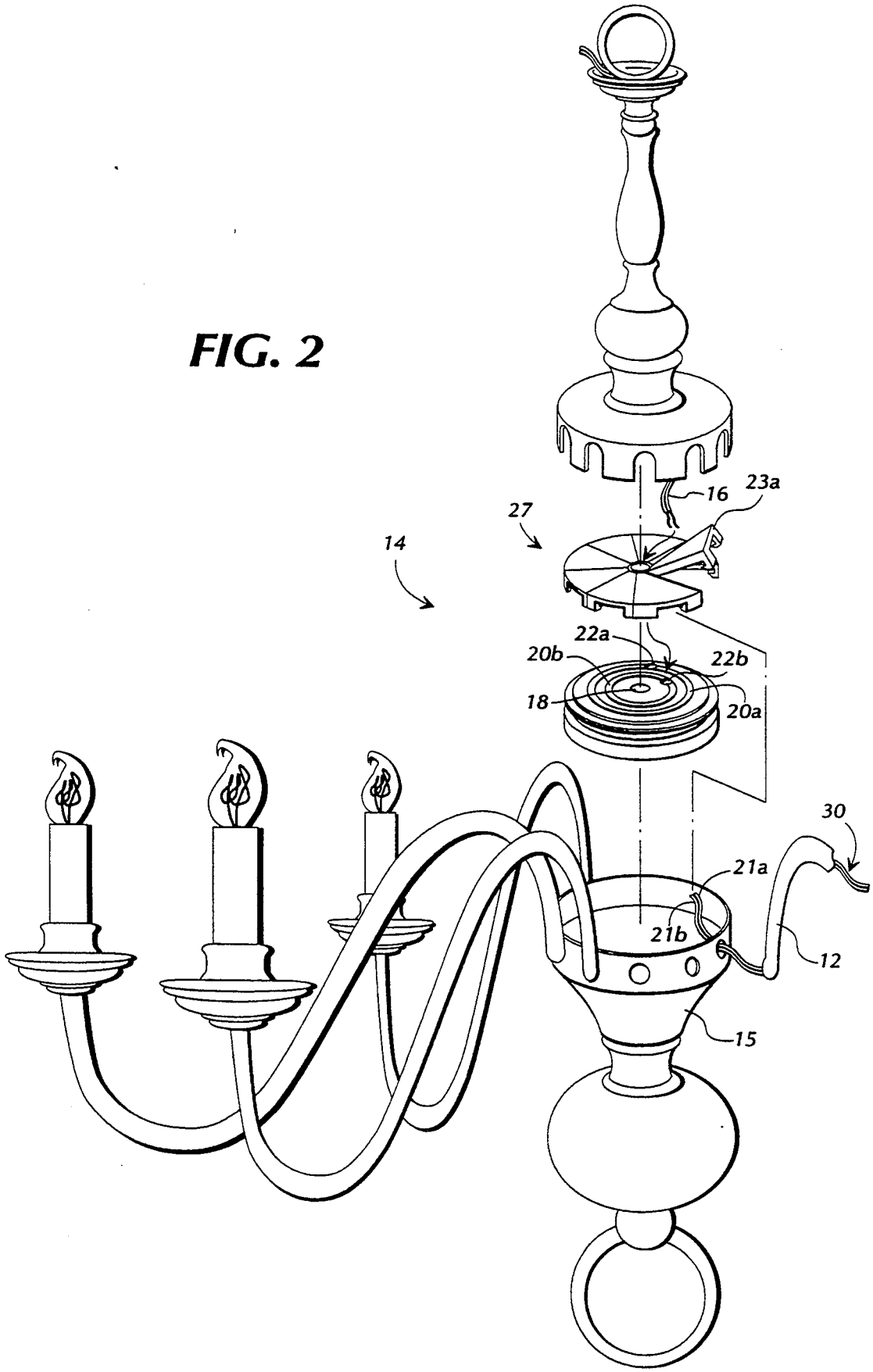
FIG. 2 is an exploded view of a chandelier in which the preferred embodiment of the present invention is utilized.

FIG. 2, an exploded view of a chandelier, shows the preferred embodiment of the present invention with the bottom portion of the wiring connector device 14 of the preferred embodiment detached and pulled away from the top portion. The device 14 has an aperture 18 that extends through its center axis so that threaded lamp pipe (not shown), well known to those skilled in the art, can extend through the device. A simple nut/washer assembly or other similar retaining device can be used to the secure the assembly to the lamp pipe and hold it in place. A pair of concentric conductive metallic strips 20*a* and 20*b* connect to the conductors 21*a* and 21*b* of a two conductor feeder wire 30 through the piercing action of exemplary conductive tines 22*a* and 22*b*. The tines 22*a* and 22*b* are attached to conductive strips 20*a* and 20*b* at angular and radial offsets to one another to facilitate connection with the conductors 21*a* and 21*b*. The grounded conductive strip 20*a* connects grounded conductors of all two conductor wires together, while the ungrounded conductive strip 20*b* connects ungrounded conductors of all two conductor wires together.

Piercing of a two conductor wire 30 is accomplished by urging clamp 23*a* onto conductors 21*a* and 21*b* as described in greater detail hereinbelow. Through this piercing action, one conductor 21*a* is connected to the grounded conductive strip 20*a*, while the other conductor 21*b* is connected to the ungrounded conductive strip 20*b*. As evidenced by the exploded view of FIG. 2, the two conductor feeder wire 30 runs from these electrical connections through the individual chandelier arm 12 to the light socket 13 (not shown). Electric current thus is distributed from a main power line 16, usually dropped from the ceiling into the chandelier body 15, to the wiring connector device 14. The wiring connector device 14 in turn supplies current to the individual feeder wire 30 that runs through the arm 12 of the chandelier. Finally, the two conductor feeder wires 30 are connected to the individual light socket 13 (not shown).

Figure 4:
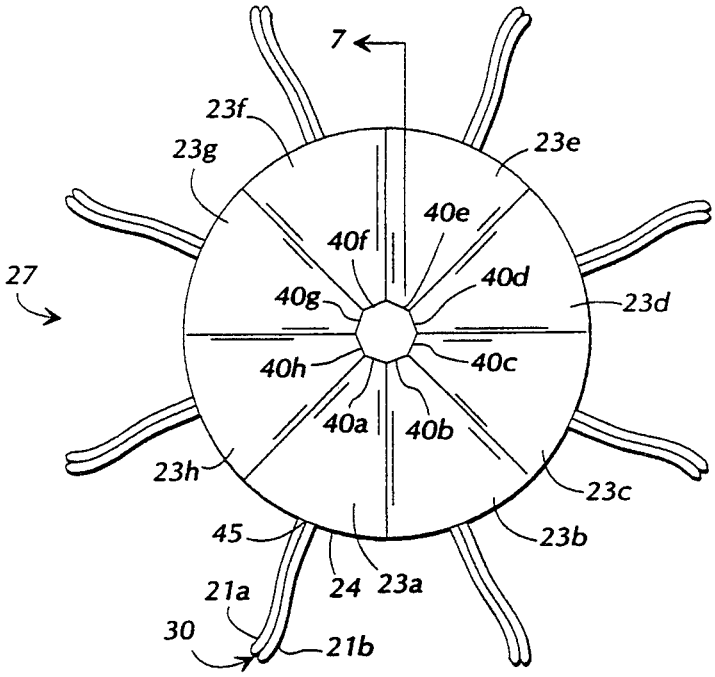
FIG. 4 is a top plan view of the preferred embodiment of the present invention.

The preferred embodiment substrate shell 27 is made of nylon or a plastic material that can be molded to provide flexible hinges of unitary construction, such as those indicated at 40*a*–40*h* in FIG. 4. Thus, each of the clamps 23*a*–23*h* has its own hinge disposed readily away from the center the wiring device. Of course, hinges constructed using other materials that are not part of the substrate material may be used to construct embodiments of the present invention, but same are less desirable as they tend to be more expensive to fabricate with no apparent increased utility to justify the increased cost.

Figure 3:
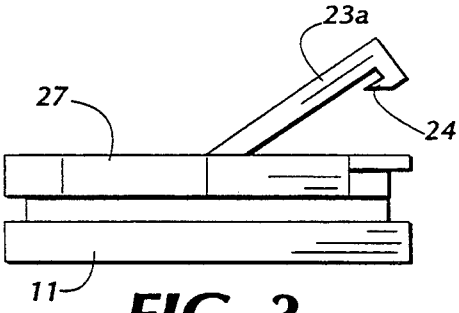
FIG. 3 is a side elevational view of the preferred embodiment of the present invention.

FIG. 3 shows a side elevational view of the preferred embodiment. This figure illustrates the substrate 11 adjoined to the sectioned top shell of substrate material 27. One exemplary clamp 23*a* is in an open position. The wiring connector device 14 is thus one unit that can be easily place in a wide range of sizes and shapes of chandelier bodies.

FIG. 4 shows a top plan view of the preferred embodiment. A radially sectioned top shell of substrate material 27 forms a plurality of individual clamps 23*a*–23*h*. Clamps 23*a*–23*h* open and close about a like plurality of hinges 40*a*–40*h*. Referring to clamp 23*a* with the understanding that clamps 23*b*–23*h* operate in the same fashion, FIG. 4 shows that clamp lip 24 fits over the top of the two conductor wire 30 via a slotted opening 45. In the preferred embodiment, the portion of the sectioned shell of substrate material 27 that acts as the individual clamp 23*a* snaps into position over the substrate lip 35 (not shown) so as to facilitate a permanent connection between the conductors 21*a* and 21*b* of the two conductor wire 30 and the conductive tines 22*a* and 22*b* (not shown).

Figure 5:
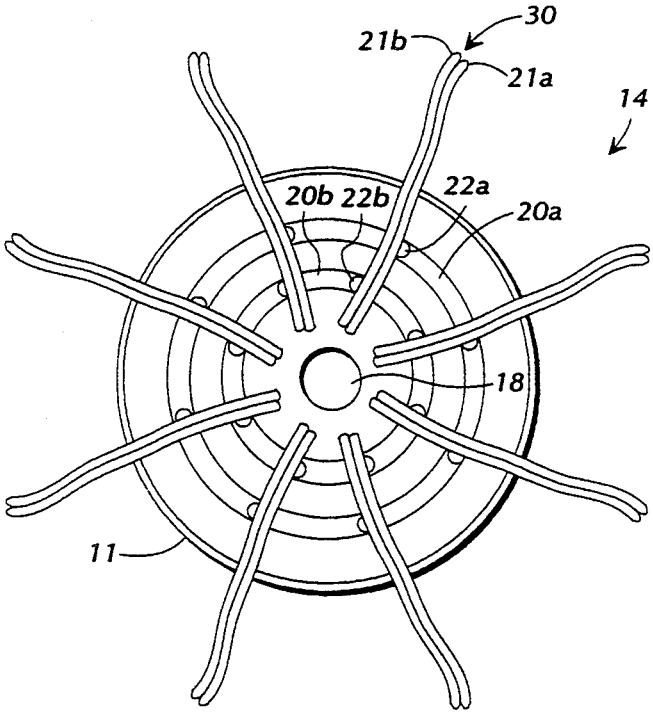
FIG. 5 is a top plan view of the preferred embodiment with the top clamps removed.

FIG. 5 shows a top plan view of the substrate 11 of the wiring connector device 14 of the preferred embodiment. The conductive strips 20*a* and 20*b* are shown along with the position of the conductive tines 22*a* and 22*b* and the positions of the corresponding conductors 21*a* and 21*b* of the two conductor wire 30. As illustrated in FIG. 5, the grounded tine 22*a* is angularly offset from the ungrounded tine 22*b*. The tines 22*a* and 22*b* connect with the conductors 21*a* and 21*b* of the two conductor wire 30. Through this connection, power supplied to the conductive strips 20*a* and 20*b* travels through the conductors 21*a* and 21*b* to the light bulb socket 13 (not shown) of the chandelier arm 12 (not shown).

Figure 6:
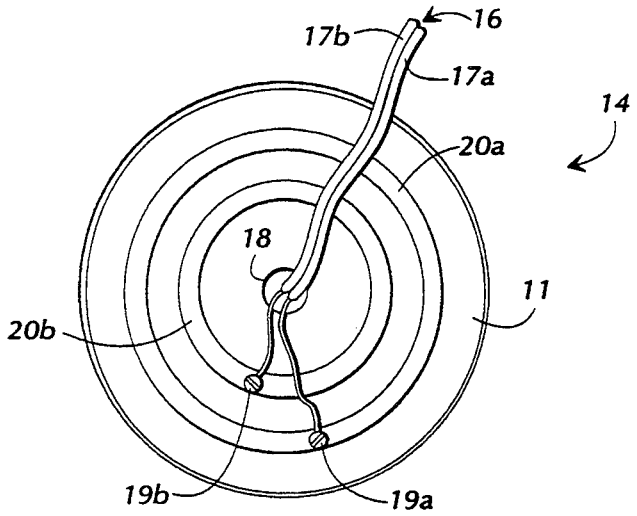
FIG. 6 is another top plan view of the wiring device with the top clamp removed, showing the main power line connections on the substrate of the preferred embodiment.

FIG. 6 is another top plan view of the substrate 11 of the wiring connector device 14. FIG. 6 shows the connection made with a power line 16 that is usually dropped from a ceiling box down to the wiring body 15 of the chandelier (not shown) and that supplies the electric current to the chandelier. The power line 16 extends down to the wiring connector device 14. The ground wire 17a of the power line 16 is then connected to the grounded conductive strip 20*a*, and the hot wire 17b of the power line 16 is connected to the ungrounded conductive strip 20*b*. The connections between the main power line wires 17*a* and 17*b* and the concentric conductive strips 20*a* and 20*b* are made through main power line connectors 19*a* and 19*b*. These connectors are typically screw posts, but any other form of physically secure connector may by used in embodiments of the present invention.

Figure 7:
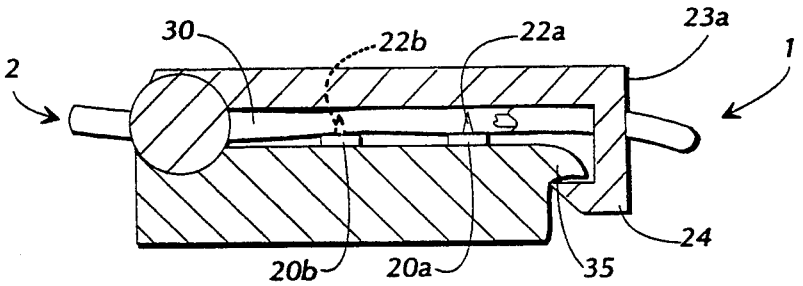
FIG. 7 is a cross-sectional side view of a representative clamp and tine pair of the preferred embodiment of the present invention engaged with a two conductor wire.
Figure 8:
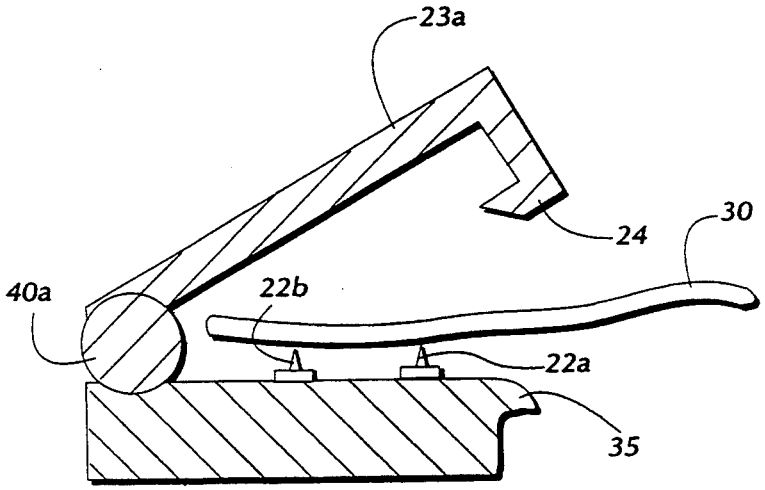
FIG. 8 is a side cross-sectional view of a representative clamp and tine pair with the clamp in an open position.

FIG. 7 is a partial cross-sectional side view of the preferred embodiment of the present invention taken along section along line 7—7 in FIG. 4. The preferred embodiment includes conductive strips as shown at 20*a* and 20*b*. The conductors make connections (shown in phantom) by tines 22*a* and 22*b* penetrating conductors 21*a* and 21*b* of the two conductor wire 30. The conductive tines 22*a* and 22*b* pierce the two conductors 21*a* and 21*b* of the two conductor wire 30 when the representative clamp 23*a* is selectively moved from an open position to a closed position. The clamp 23*a* is then secured in a closed position by guiding the clamp lip 24 over and onto the substrate lip 35. As shown in FIG. 8, the clamp 23*a* rotates axially about the axis of a hinge 40*a* from an open position to a closed position in which the clamp lip 24 engages with the substrate lip 35, and causes tines 22*a* and 22*b* to pierce the two-conductor wire 30.

Figure 9:
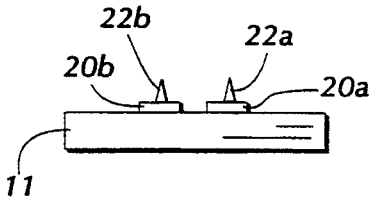
FIG. 9 is a cross-sectional end elevational view of a representative tine pair of the preferred embodiment of the present invention.
Figure 10:
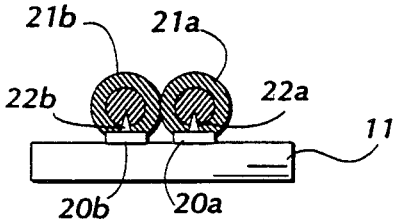
FIG. 10 is a cross-sectional illustration of a two conductor wire in contact with a representative tine pair of the preferred embodiment of the present invention.

FIG. 9 shows a cross-sectional view of the bottom disc-shaped surface portion of the preferred embodiment of the present invention. In FIG. 9, conductive tines 22*a* and 22*b* are connected to conductive strips 20*a* and 20*b*. This combination in turn is embedded in or secured to the substrate 11. FIG. 10 illustrates how the conductive tines 22*a* and 22*b* pierce the conductors 21*a* and 21*b* and thus transfer current from the conductive strips 20*a* and 20*b* to the conductors 21*a* and 21*b*, and ultimately to each chandelier light socket 13 (not shown).

Figure 11A:
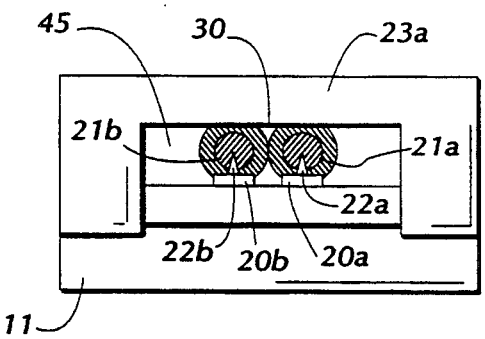
Figure 11B:
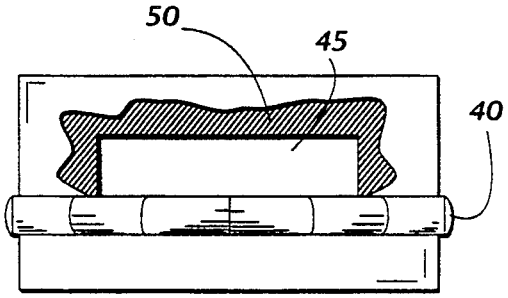

Turning next to FIGS. 11*a* and 11*b*, front and rear views through the clamp of FIG. 6 are shown. FIG. 11*a* illustrates the front end of the slot 45, as viewed from arrow I in FIG. 7, in the clamp 23*a* for urging the two conductor wire 30 into an aligned position with the conducting tines 22*a* and 22*b*. In FIG. 1*a*, the clamp 23*a* is shown in a closed position and engaged with the substrate 11. When the clamp 23*a* is moved into a closed position, the conducting tines 22*a* and 22*b* pierce and connect the conductors 21*a* and 21*b* with the grounded and ungrounded conductive strips 20*a* and 20*b*. FIG. 1*b* illustrates a cross-sectional rear view perpendicular to the longitudinal axis of slot 45 and hinge 40, as viewed looking outwardly in the direction of arrow 2 in FIG. 7. The rear 50 of the slot 45 is larger in comparison to the front opening of the slot 45. This allows the two conductor wire 30 to be urged into position for connection with the two conductive tines 22*a* and 22*b*.

Figure 12:
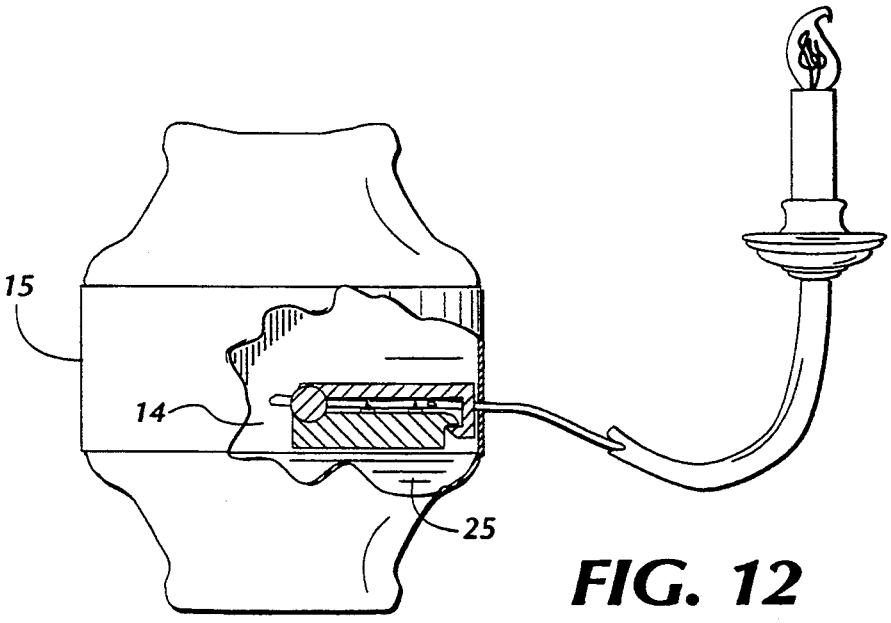
FIG. 12 is a partial cross-sectional view of the wiring connector device as implemented in a chandelier body.

FIG. 12 is a partially sectioned side elevational view of the wiring connector device 14. The main power line 16 (not shown) is directed into the chandelier wire body 15 and then into the wiring connector device 14 itself. The device is held in place by the wire body support 25.

While the preferred embodiment has been disclosed with respect to a wiring connector device for use in a chandelier, it should be understood that the structure of the wiring connector device of the present invention can also be used for any electrical application requiring distribution of electrical power to various conductors. Stated another way, this apparatus has utility as a junction box.

Further, while the preferred embodiment has been disclosed with respect to a circular, or disc-shaped, wiring connector device, it will also be understood that the device can be rectangular, square, triangular, oblong or any other shape required by a particular application.

The nature of this apparatus lends itself to construction from a wide variety of materials. In the preferred embodiment, the substrate is made from conventional material used by those skilled in the electrical arts. However, other nonconducting materials, such as glass or plastic, could also be used. Furthermore, while the conductive tines 22*a* and 22*b* are made of a high conductivity metal such as copper in the preferred embodiment, other conducting materials may also be used.

From the foregoing description of the preferred embodiment of the present invention, other embodiments of the present invention will suggest themselves to those skilled in the art. Particular details of the preferred embodiment are included to fully disclose the best mode of the invention contemplated by the inventor and should not be taken as limiting of the scope of the present invention. Therefore, the scope of same is to be limited only by the claims below and equivalents thereof.

I claim:

1. An electrical connection device for wiring a chandelier comprising in combination:

a substrate;

means for supporting said substrate at a support axis for said chandelier;

a plurality of pairs of electrically conductive tines disposed on said substrate radially about said support axis, each of said pairs of electrically conductive tines comprising a grounded tine and an ungrounded line;

conducting means for connecting all of said grounded tines together and all of said ungrounded tines together; wherein each of said pairs of tines is under one of a plurality of clamps and each clamp of said plurality of clamps is selectively movable between an open position at which said pair of tines is exposed so that a parallel two conductor wire can be laid across said pair of tines and a closed position at which said clamp urges said two conductor wire onto said pair of tines so that the grounded tine of said pair pierces the insulation of one conductor of said two conductor wire and the ungrounded line of said pair pierces the insulation of the other conductor of said two conductor wire.

2. An electrical connection device as recited in claim 1 wherein structural grooves house said conductors and said tines, and in which said clamps are compressed to connect said tines and said two-conductor wires.

3. An electrical connection device as recited in claim 1 wherein said grounded tine connects said conducting means to a first section of said two-conductor wire.

4. An electrical connection device as recited in claim 2 wherein said conducting means is grounded.

5. An electrical connection device as recited in claim 1 wherein said ungrounded tine connects said conducting means to a second section of said two-conductor wire.

6. An electrical connection device as recited in claim 5 wherein said conducting means is connected to a hot wire of a power line.

7. An electrical connection device as recited in claim 1 wherein a power feed line supplies electrical power to said conducting means for distribution across said two-conductor wire.

8. An electrical connection device as recited in claim 7 wherein said power feed line, by being connected to an electrical power supply, supplies electricity to said conducting means.

9. An improved electrical connection device for connecting a plurality of wires to a plurality of electrical outputs, comprising in combination:

a first plurality of metal conductors that spans an inner circumference of said electrical connection device;

a second and like plurality of metal conductors that spans an outer circumference of said electrical connection device;

a plurality of piercing connectors connected to said first and second pluralities of metal conductors for penetrating said plurality of wires;

a plurality of latches for holding said plurality of wires in contact with said plurality of piercing connectors.

10. An improved electrical connection device as recited in claim 9, wherein said electrical outputs are chandelier light sockets.

11. An improved electrical connection device as recited in claim 9, wherein a first piercing connector connects a first conductor of a two-conductor wire to a hot metal conductor.

12. An improved electrical connection device as recited in claim 9, wherein a second piercing connector connects a second conductor of a two-conductor electrical wire to a grounded metal conductor.

13. An improved electrical connection device as recited in claim 9, wherein said piercing connectors and said wires are disposed in a plurality of slots, and said latches are selectively operable to urge said wires into contact with said piercing connectors.

14. An improved electrical connection device as recited in claim 9 wherein a main power cord supplies power to said first and second pluralities of metal conductors.

15. An improved electrical connection device as recited in claim 9 wherein said connection device has a disc-shaped non-conducting surface that fits in a base/-body of a chandelier.

16. An improved electrical connection device as recited in claim 15 wherein said connection device is circular in shape.

17. An improved electrical connection device for use in a chandelier or similar electrical apparatus that distributes electricity to light sockets of said chandelier, said connection device comprising;

a substrate having a geometric center;

a first continuous conducting strip that spans a first circumference of said connection device, is connected to a grounded source and is adherent to said substrate;

a second continuous conducting strip that spans a second circumference of said connection device, is connected to a non-grounded source and is adherent to said substrate;

a plurality of wire pairs, each having a characteristic longitudinal axis;

a plurality of pairs of piercing prongs, one pair corresponding to each of said light sockets to tap one of said wire pairs, wherein a first prong from each of said pairs is radially disposed at a first distance from said center of said substrate, and originates from said conducting strip connected to said grounded source, and wherein a second prong from each of said pairs is radially disposed at a second distance from said center of said substrate and originates from said conducting strip connected to said non-grounded source;

a plurality of clamps, wherein one clamp of said plurality corresponds to each of said pairs of piercing prongs, for establishing a connection between said piercing prongs and said plurality of wire pairs in response to rotation about an axis perpendicular to said longitudinal axis of said wire pairs, said clamps having a groove at an end thereof for aligning said wire pairs with said pair of piercing prongs.

18. An improved electrical connection device as recited in claim 17, wherein said rotation of said clamp about said axis of rotation is between an open position and a closed position in which said wire pair passes through said groove and said clamp is in a plane parallel to said substrate.

19. An improved connection apparatus for supplying electricity to a plurality of wire pairs and electrical outputs of a device, comprising in combination:

a substrate means for supplying a base for the apparatus;

a support means for said substrate at a support axis of said device;

a plurality of piercing means for connecting said wire pairs to said outputs, said piercing means being arranged radially away from said support axis and lying substantially in a single plane that is perpendicular to said support axis;

a grounded conducting means for connection with a first wire in each of said plurality of wire pairs;

an ungrounded conducting means for connection with a second wire in each of said plurality of wire pairs; and a plurality of clamping means, for urging connection of said plurality of wire pairs with said piercing means, to make a connection with said grounded and ungrounded conducting means, when said clamping means are in a locked position in a plane parallel to said substrate, said clamping means being movable from an opened position to a locked position in a plane parallel to said substrate.

* * * * *